United States Patent [19]

Takehana

[11] Patent Number: 4,815,501

[45] Date of Patent: Mar. 28, 1989

[54] METHOD OF DISCRIMINATING AND CHANGE A YARN PACKAGE

[75] Inventor: Tatsuo Takehana, Ishikawa, Japan

[73] Assignee: Tsudakoma Corp., Ishikawa, Japan

[21] Appl. No.: 167,150

[22] Filed: Mar. 16, 1988

[30] Foreign Application Priority Data

Mar. 16, 1987 [JP] Japan ..... 62-062289
Mar. 30, 1987 [JP] Japan ..... 62-077179

[51] Int. Cl.[4] ..... D03D 47/00

[52] U.S. Cl. ..... 139/429; 139/450; 139/452

[58] Field of Search ..... 139/429, 450, 435, 452, 139/116, 370.2

[56] References Cited

U.S. PATENT DOCUMENTS 4,446,893 5/1984 Gunneman et al. ..... 139/116
4,450,876 5/1984 van Mullekom ..... 139/435
4,458,726 7/1984 Wenig ..... 139/116
4,550,753 11/1985 Tsuji ..... 139/435
4,658,866 4/1987 Takegawa ..... 139/452
4,716,941 1/1988 Takegawa ..... 139/435

*Primary Examiner*—Henry S. Jaudon
*Attorney, Agent, or Firm*—Wenderoth, Lind & Ponack

[57] ABSTRACT

In a fluid jet loom, almost all the faulty picks are attributable to defects in the quality of the weft yarn. The present invention detects matters for evaluating the physical properties of the weft yarn or matters for evaluating the result of the picking operation during the picking operation, discriminates the quality of the yarn package on the basis of data obtained through the detection, and automatically changes the yarn package for a new yarn package when it is decided that the yarn package feeding the weft yarn at present is defective.

16 Claims, 2 Drawing Sheets

METHOD OF DISCRIMINATING AND CHANGE A YARN PACKAGE

BACKGROUND OF THE INVENTION

1. Field of the Invention

The present invention relates to a picking system for a fluid jet loom and, more particularly, to a method of discriminating a yarn package in quality and automatically changing the yarn package on the basis of discrimination when necessary.

2. Description of the Prior

In the weaving operating of a fluid jet loom, a weft yarn unwound from a yarn package is measured by and is stored on a measuring and storing device, and then the weft yarn stored on the measuring and storing device is picked into the shed at a predetermined picking moment by picking device. The arrival of the picked weft yarn is detected electrically by one or two weft feelers provided on the arrival side of the loom. Upon the detection of faulty pick, such as the entanglement of the picked weft yarn, long pick, short pick or broken pick, the weft feeler gives a weft stop signal, which is different in level from a signal which is generated by the weft feeler during the normal picking operation, to the control unit of the loom.

In a weaving mill, an operator examines the condition of the loom stopped by the weft stop motion, finds out the cause of faulty pick perceptively from experience, and then adjusts the picking device when the picking device is not adjusted properly, or changes the yarn package when the weft stop is attributable to the bad quality of the package to prevent successive weft stop.

However, since such a correcting procedure is based on operator's empirical perception and is not ensured by numerical data, it is possible that the correcting procedure is inappropriate, and operator's attentive effort is required, which is undesirable from the viewpoint of reducing labors of the operator.

SUMMARY OF THE INVENTION

Accordingly, it is an object of the present invention to provide a method of discriminating and changing a yarn package, capable of numerically discriminating the quality of a yarn package being used during the picking operation on the basis of the analysis of data representing the condition of the weft yarn without requiring the perceptive ability and experience of the operator, and capable of changing the yarn package for another when necessary.

According to the present invention, the actual condition of a picked weft yarn is detected by a weft feeler during the picking operation to obtain data representing the actual condition of the picked weft yarn, a signal representing the data, generated by the weft feeler every picking cycle is stored, the quality of the yarn package is discriminated through the comparison of the sequential signals provided by the weft feeler with predetermined conditions, for example, reference data, and yarn package is changed for another when the result of the comparison requires.

The actual condition of the picking operation is detected by a weft feeler or feelers provided on the running path of the weft yarn. Ordinarily, a weft feeler is provided on the weft yarn arrival side of the loom or, if necessary, weft feelers are provided on the weft yarn arrival side and before the picking device, respectively. A signal provided by the weft feeler provided on the weft yarn arrival side carries information regarding the condition of the picking operation and the arrival time of a picked weft yarn. A signal provided by the weft feeler provided before the picking device does not carry any information regarding the arrival time of a picked weft yarn and carries only information regarding faulty pick attributable to weft yarn breakage. A controller processes the signals provided by a plurality of weft feelers individually or in combination to discriminate the quality of the yarn package accurately. The data for evaluating the actual condition of the picking operation may be the physical properties of the weft yarn, such as the thickness of the weft yarn, or values indicating the picking condition, such as the tension of the picked weft yarn.

According to the present invention, the stored data is compared with the reference data periodically and an instruction to change the yarn package is issued when the stored data deviates from the reference data beyond a predetermined range. Accordingly, the reliability of the discrimination of the quality of the yarn package is higher than that of the discrimination of the quality of the yarn package based on the empirical perception and attention of the operator, the operator is relieved from work for discriminating the quality of the yarn package, which is effective from the viewpoint of improving the working condition of the operator.

The above and other objects, features and advantages of the present invention will become more apparent from the following description taken in conjunction with the accompanying drawings.

DESCRIPTION OF THE PREFERRED EMBODIMENTS

Figure 1:
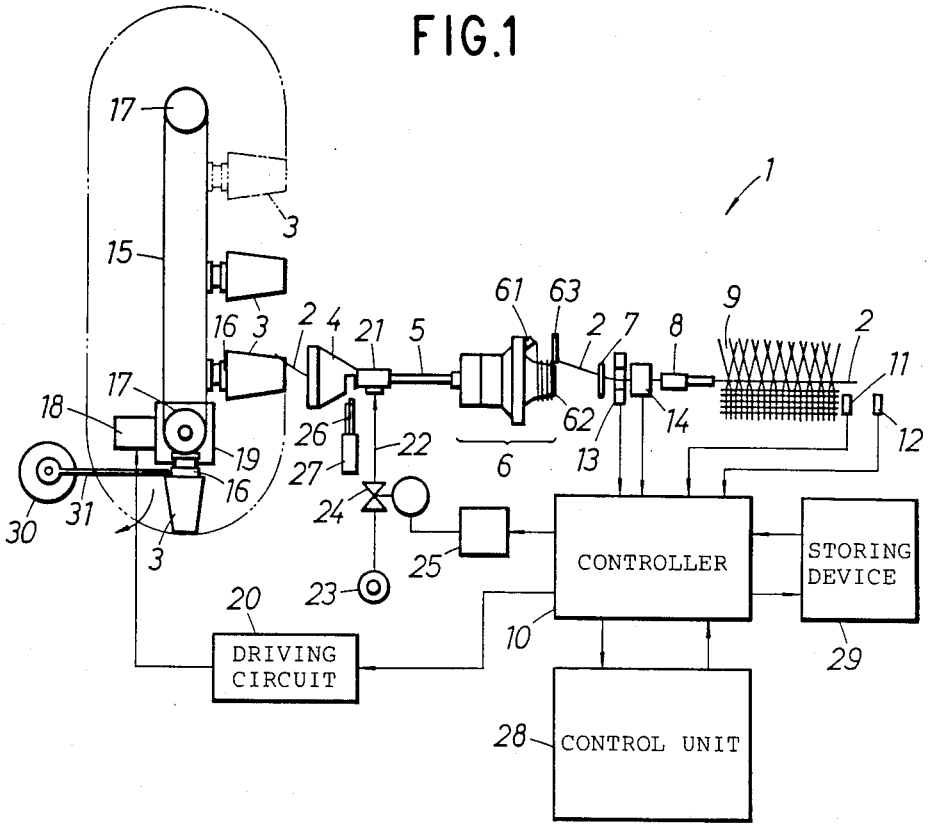
FIG. 1 is a schematic plan view of a picking device incorporating a system for carrying out a method of discriminating a changing a yarn package, in a preferred embodiment, according to the present invention.

Referring to FIG. 1 showing the picking device 1 of a fluid jet loom for carrying out a method of discriminating and changing a yarn package, according to the present invention, a weft yarn 2 unwound from one of a plurality of yarn packages 3 is drawn through a funnel-shaped guide member 4 and a guide tube 5. The weft yarn 2 is measured by the cooperative operation of the rotary yarn guide 61 and drum 62 of a measuring and storing device 6, for example, of a drum type and the measured weft yarn 2 is held on the drum 62 with a stopping pin 63. In picking the weft yarn 2 stored on the drum 62, the stopping pin 63 is retracted and the weft yarn 2 is drawn out from the drum 62 through a yarn guide 7 and is picked together with a picking fluid into the shed 9 by a picking device 8 such as a picking nozzle. Photoelectric weft feelers 11 and 12 are provided near the selvage on the weft arrival side of the loom.

The final position of the free end of the picked weft yarn 2 on the weft arrival side is detected by one of or both the weft feeler 11 and 12. Upon the detection of the free end of the picked weft yarn 2, the weft feelers 11 and 12 give electric signals to a controller 10. The electric output signals of the weft feelers 11 and 12 represent data indicating the condition of the picked weft yarn 2, such as an arrival time and faulty pick. The weft feeler 11 is disposed at a position where the free end of a normally picked weft yarn 2 is able to reach without fail, and the weft feeler 12 is disposed at a position where the free end of a normally picked weft yarn 2 is unable to reach. A weft feeler 13 and a thickness detector 14 is provided on a path between the yarn package 3 and the picking device 8. The weft feeler 13 detects the breakage of the weft yarn 2 before the picking device 8 and gives a signal to the controller 10 to inform the controller 10 of the possibility of faulty pick. The thickness detector 14 has an optical sensor or the like capable of detecting the thickness of the weft yarn 2, namely, one of the physical properties of the weft yarn 2, through the measurement of the quantity of light representing the thickness of the weft yarn 2 and gives an electric signal corresponding to the quantity of light to the controller 10. The weft feeler 13 and the thickness detector 14 need not necessarily be provided.

The respective weft yarns 2 of the plurality of yarn packages 3 are not interconnected. The yarn packages 3 are arranged individually at predetermined regular intervals and fixedly held, for example, on a holder 16 of an endless conveyor belt 15. The yarn packages 3 are shifted sequentially from a standby position to a yarn feed position. The conveyor belt 15 is extended, for example, in a horizontal plane between a pair of wheels 17. One of the wheels 17 is turned through a predetermined indexing angle at a time by an indexing motor 18 and an indexing mechanism 19. Thus, the plurality of yarn packages 3 are moved automatically one at a time to a position opposite the funnel-shaped guide member 4, namely, the yarn feed position, when necessary. A cutter 26 and a cutter driving unit 27 are provided near the neck of the guide member 4 so as to be advanced toward or retracted from the neck of the guide member 4 by a power cylinder, not shown, or suitable means.

The rotational operation of the indexing motor 18 is controlled by the controller 10 through a driving circuit 20 in an on-off control mode. The guide member 4 is provided at the neck thereof with a blow nozzle 21 for generating an air current within the guide tube 5 in the yarn feed direction to pass the weft yarn 2 through the guide member 4 and the guide tube 5 into the interior of the rotary yarn guide 61 of the measuring and storing device 6. The blow nozzle 21 is connected through a shutoff solenoid valve 24 by a pipe 22 to a compressed air source 23. The shutoff solenoid 24 is driven by a valve driver 25 which, similarly to the driving circuit 20, is controlled by the controller 10.

Incidentally, the controller 10 comprises a microcomputer, and is connected also to the control unit 28 of the loom and storage device 29. The controller 10 stores a control program based on the method of the present invention, receives signals from the weft feelers 11, 12 and 13 and the thickness detector every picking cycle, sequentially executes necessary functions including operations, data storage and control operation to discriminate the quality of the yarn package 3 feeding the weft yarn 2 and, when necessary, to execute a series of threading control operations for threading the weft yarn 2 of a new yarn package 3 to the measuring and storing device 6 instead of the weft yarn 2 of the yarn package feeding the weft yarn 2 at present.

A swingable yarn package removing lever 31 is provided at a yarn package removing position near the conveyor belt 15. The yarn package removing lever 31 is driven for swing motion in a predetermined direction by a driving unit 30 such as a rotary solenoid unit.

During the weaving operation, the rotary yarn guide 61 of the measuring and storing device 6 draws out the weft yarn 2 from the yarn package 3 located at the yarn feed position and winds the weft yarn 2 around the drum 62 by a predetermined number of turns to measure and store the weft yarn 2 on the drum 62 while the stopping pin 63 holds the weft yarn 2 on the drum 62. At the start of the picking operation, the stopping pin 63 is retracted from the drum 62 to release the weft yarn 2 so that the weft yarn 2 can be picked, and then the picking device 8 jets the picking fluid into the shed 9 to pick a predetermined length of weft yarn 2 into the shed 9 by the agency of the jet of the picking fluid.

Figure 2:
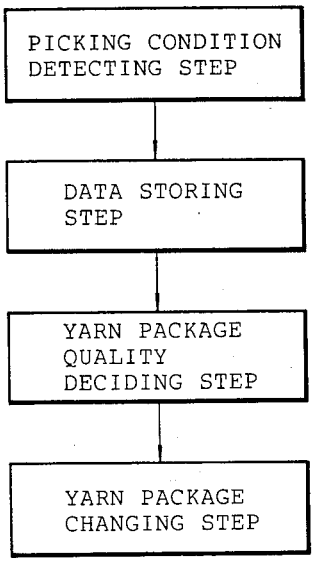
FIG. 2 is a flow chart showing steps of control operation to be executed by the system for carrying out the method of discriminating and changing a yarn package, incorporated into the picking device of FIG. 1.

Meantime, the controller 10 starts sequentially executes the steps of the control program as shown in FIG. 2 based on the method of discriminating and changing a yarn package of the present invention to discriminate the quality of the yarn package 3 feeding the weft yarn at present and, if necessary, to change the yarn package 3 for a new one.

During the weaving operation, the weft feelers 11 and 12 detects the free end of the picked weft yarn 2 every picking cycle and give detection signals representing the result of the picking operation to the controller 10 (picking condition detecting step). Time when the detection signals are generated is data indicating the variation of the arrival time, and the variation of the detection signals in level is data indicating faulty picking operation.

FIGS. 3A through 3D illustrate various modes of pick in relation with the three weft feelers 11, 12 and 13.

Figure 3:
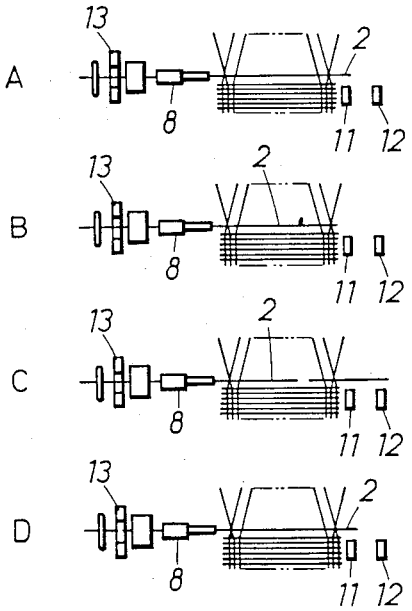
FIGS. 3A through 3E are diagrammatic illustrations of various conditions of picked weft yarns.

FIG. 3A shows a normal pick, in which the weft feelers 11 and 13 detects the weft yarn 2 and generate, for example, detection signals of H-level, respectively. FIG. 3B shows a short pick or a faulty pick attributable to the entaglement of the picked weft yarn 2, in which the weft feelers 11 and 12 generate detection signals of L-level, respectively. FIG. 3C shows a faulty pick attributable to the breakage of the picked weft yarn 2 due to untwisting or the like, in which all the weft feelers 11, 12 and 13 generate detection signals of H-level, respectively. FIG. 3D shows a faulty pick attributable to the breakage of the weft yarn 2 at a position before the picking device 8, in which the weft feeler 13 generates a detection signal of L-level while the level of the detection signals generated by the weft feelers 11 and 12 is indefinite. Among those faulty states of pick, the faulty states of pick shown in FIGS. 3C and 3D are attributable to the insufficient strength of the weft yarn, and hence the causes of those faulty states of pick can be eliminated by changing the yarn package 3.

The thickness detector 14 detects the thickness, one of the physical properties, of the picked weft yarn 2 while the same is running, and gives an electric signal representing data indicating the thickness of the picked weft yarn 2 to the controller 10.

Then, upon the reception of the detection signal indicating a faulty pick, the controller 10 gives a weft stop signal to the control unit 28 of the loom to stop the loom and stores the detection signal in the storage device 29 at an address assigned to each yarn package 3 (data storing step). Meantime, the faulty pick is corrected, and then the control unit 28 of the loom restarts the loom.

On the other hand, the controller 10 reads data indicating the states of pick from the storage device 29 every predetermined period, for example, every predetermined number of picking cycles, every fixed period of time or every stoppage of the loom, adds up the data indicating faulty pick and compares the frequency of faulty pick with a reference frequency of faulty pick which is possible when a weft yarn is supplied by a good yarn package to numerically decide whether or not the detection signals indicate that the yarn package is defective. The reference frequency of faulty pick is determined previously on the basis of data obtainted through the statistical quality control of yarn packages. If necessary, the reference frequency of faulty pick and the measured data are read from the storage device 29 and are displayed on a display provided on the controller 10 for visual confirmation of the condition of the yarn package. When the measured frequency of faulty pick is found to be statistically excessively greater than the reference frequency of faulty pick, the controller 10 decides that the yarn package 3 feeding the weft yarn at present is defective, gives a yarn package change signal to the driving unit 27 for driving unit 27 for driving the cutter 26 and to the driving circuit 20, and gives a signal to the control unit 28 of the loom to stop the loom automatically (yarn package quality deciding step).

Then, the cutter 26 is advanced from the retracted position to cut the weft yarn 2 fed from the defective yarn package 3 at a position near the neck of the guide member 4. At the same time or a little after the actuation of the cutter 26, the controller 10 opens the shutoff solenoid valve 24 to blow air through the blow nozzle 21, so that an air current is generated through the interior of the guide tube 5 in the threading direction to discharge the weft yarn 2 from the rotary yarn guide 61. Then, the operator or a known automatic yarn removing device removes the weft yarn 2 extending between the measuring and storing device 6 and the picking device 8 and remaining on the drum 62. The known automatic yarn removing device comprises, for example, a yarn discharging mechanism including a suction pipe and a winding roller, which is provided near the outlet of the picking device 8. The yarn discharging mechanism removes the waste weft yarn 2 automatically by discharging the same when the picking device 8 jets the picking fluid. Then, after confirming the completion of a series of yarn package changing procedures, the controller 10 gives a start signal to the driving circuit 20 to actuate the indexing motor 18 for driving the indexing mechanism 19 so that the defective yarn package 3 is shifted from the feed position to the removing position and a new yarn package 3 is located automatically at the feed position. In this state, the leading end of the weft yarn 2 wound on the new yarn package 3 is free. Then, the blow nozzle 21 blows air to generate an air current through the guide member 4 in the threading direction, and thereby the leading end of the weft yarn 2 of the new yarn package 3 is sucked into the interior of the guide tube 5 by the air current flowing through the guide member 4 and projects from the outlet of the rotary yarn guide 61 to be ready to be wound on the drum 62. After the passage of a fixed time from the start of the yarn package changing operation, the controller 10 confirms the completion of the operation for threading the weft yarn 2 by detecting the leading end of the weft yarn 2 projecting from the outlet of the rotary yarn guide with a sensor provided near the outlet of the rotary yarn guide 61. Thus, the yarn package changing operation is completed. Then, the controller 10 gives a start permission signal to the control unit 28 of the loom (yarn package changing step).

Incidentally, the defective yarn package 3 shifted from the feed position to the removing position is removed from the holder 16 by the yarn package removing lever 31. The driving unit 30 for driving the yarn package removing lever 31 is actuated upon the confirmation of the start instruction provided by the controller 10 and the completion of the shift of the defective yarn package 3 to the removing position after the yarn package changing operation has been completed.

Then, a length of the weft yarn 2 necessary for the next picking operation is unwound from the new yarn package 3 and stored on the drum 62 of the measuring and storing device 6, and then the leading end of the weft yarn 2 is passed through the picking device 8. The preparatory storage of the weft yarn 2 on the drum 62 and the threading of the weft yarn 2 through the picking device can be carried out by the invention made by the applicant of the present invention and disclosed in Japanese Patent Application No. 60-196822 (U.S. patent application Ser. No. 903,816, EPC Patent Application No. 86 112 239.8). The loom starts a weaving operation thereafter.

Although this embodiment, evaluates the quality of the yarn package 3 only on the basis of the frequency of faulty pick, variations in arrival time detected by the weft feeler 11 may be employed, in addition to the frequency of faulty pick, in evaluating the quality of the yarn package 3. As mentioned previously, the detection signal of the weft feeler 11 goes HIGH upon the detection of the free end of the picked weft yarn 2. The moment of generation of the detection signal of H-level is the arrival time, which is expressed by the corresponding crankpin angle of the loom. When the yarn package 3 is defective, the actual arrival time varies according to the defective physical properties of the weft yarn 2, and hence the variation of the arrival time can be used individually as a criterion for evaluating of the quality of the yarn package 3. The use of the variation of the arrival time as a criterion in combination with the frequency of faulty pick increases the bases of evaluation and thereby the reliability of the evaluation of the quality of the yarn package 3 is enhanced accordingly.

The arrival time can be detected indirectly near the measuring and storing device 6. That is, the weft yarn 2 runs along the circumference of the drum 62 when the weft yarn 2 is picked, and the movement of the weft yarn 2 along the circumference of the drum 62 is proportional to the flight distance of the free end of the weft yarn 2. Accordingly, provided that the length of the weft yarn 2 to be wound around the drum 62 for one picking cycle is, for example, four turns, then a moment when the four turns of the weft yarn 2 is unwound from the drum 62 corresponds to the arrival time of the free end of the picked weft yarn 2.

Figure 4:
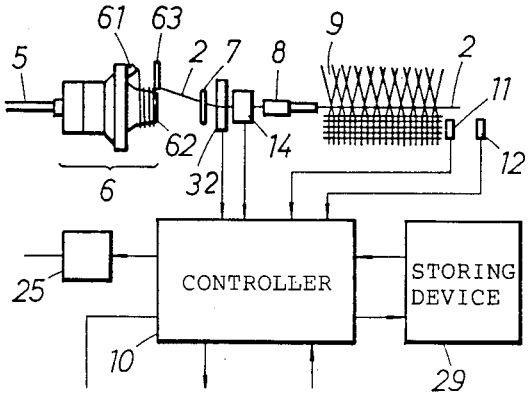
FIG. 4 is a fragmentary plan view showing a system for carrying out a method of discriminating and changing a yarn package, n another embodiment, according to the present invention.

Although this embodiment evaluates the data representing the condition of pick, the physical properties of the weft yarn 2 may be evaluated. The physical properties of the weft yarn 2 can be detected by a tension detector 32 provided in addition to the thickness detector 14 as shown in FIG. 4. The tension detector 32 and the thickness detector 14 detect the variable physical properties, namely, the tension and thickness, of the picked weft yarn 2, respectively, while the picked weft yarn 2 is running and give electrical signals respectively representing the tension and thickness to the controller 10.

Then, the controller 10 processes the respective data of the physical properties periodically every predetermined interval, for example, every predetermined number of picks or every fixed period of time, to obtain the difference between the maximum and minimum values of thickness, the difference between the maximum and minimum values of tension, the difference between the earliest and latest values of arrival time detected by the weft feeler 11, and the frequency of faulty pick in a unit time or in a unit number of rotation of the crankshaft of the loom detected by the weft feelers 11 and 12, and then compares these differences with the corresponding reference differences to determine the quality of the yarn package 3 numerically.

When the difference between the maximum and minimum values of tension is greater than the reference difference and the frequency of faulty pick detected by the weft feeler 12 is excessively greater than the reference frequency, namely, when both the physical properties of the weft yarn 2 and the variation of the arrival time are deviating excessively greatly respectively from the references, the controller 10 decides that the yarn package 3 is defective and that the yarn package 3 must be changed for a new yarn package 3.

The basis for deciding the differences of the physical properties of the weft yarn 2 from the references is not limited to the difference between the maximum and minimum values of the measured physical properties. For example, the frequency of occurrence of abnormal tension in a predetermined number of picking cycles, the occurrence of runs of defects in the weft yarn 2 in a predetermined time, and the frequency of occurrence of abnormal tension in a predetermined time may also be applied to deciding the quality of the yarn package. The respective significances of the difference of the physical properties of the weft yarn 2 from the references, and the variation of the arrival time can be determined by a statistical method. The statistical method is effective for deciding the quality of the yarn package at a high reliability. The statistical method processes the respective data of the physical properties and arrival time on an assumption that the distribution of the data is represented by a normal distribution curve. The statistical method compares the mean values and reference deviations of the data with the corresponding references to decide the quality of the yarn package 3 feeding the weft yarn at present.

In either case of decision, conditions for deciding the quality of the yarn package 3 may optionally be determined. The conditions for deciding the quality of the yarn package 3 may include the deviation of data from the corresponding reference, the frequency of abnormal state in a predetermined time, the frequency of faulty pick in a predetermined number of picking cycles exceeding the corresponding reference, an abnormal picking operation in which faulty picks occur successively. The method of the present invention need not be executed continually during the weaving operation of the loom; the method is sufficiently effective only if the method is started upon the occurrence of the first faulty pick after the loom has been started. Concrete examples of the above-mentioned data processing procedures are disclosed in Japanese Laid-Open Patent Publication Nos. 49-9435, 50-118062 and 54-2457 and Japanese Patent Publication Nos. 52-8904 and 60-1145.

Although the invention has been described in its preferred form with a certain degree of particularity, it is to be understood that many variations and changes are possible in the invention without departing from the scope thereof.

What is claimed is:

1. In a fluid jet loom in which a weft yarn is unwound from a yarn package, the weft yarn is measured and stored by a measuring and storing device, and then the weft yarn stored in the measuring and storing device is picked into a shed, a method of discriminating and changing a yarn package, comprising:

a picking condition detecting step in which detecting matters for evaluating the weft yarn are detected while the picked weft yarn is running along the running path and detection signals representing the matters detected are generated;

a data storing step in which data corresponding to the detection signals generated in the successive picking cycles are stored sequentially;

a yarn package quality deciding step in which the stored data is read and yarn package changing instruction is provided to change the yarn package feeding the weft yarn at present for a new yarn package when data indicates that the yarn package feeding the weft yarn at present is defective; and a yarn package changing step in which, in response to the yarn package changing instruction, the yarn package feeding the weft yarn at present is shifted from the feed position to the removing position and a new yarn package is located at the feed position, and the weft yarn of the new yarn package is unwound from the new yarn package and is extended to the measuring and storing device.

2. A method of discriminating and changing a yarn package, according to claim 1, wherein at least either the result of picking operation or arrival time at which the picked weft yarn arrives at a position on the arrival side of the loom is detected as a matter for evaluating the condition of the picking operation in the picking condition detecting step.

3. A method of discriminating and changing a yarn package, according to claim 2, wherein the frequency of faulty picks in a predetermined period is compared with a reference frequency in the yarn package quality deciding step.

4. A method of discriminating and changing a yarn package, according to claim 2, wherein the respective variations of the data for evaluation are compared respectively with the corresponding reference variations in the yarn package quality deciding step.

5. A method of discriminating and changing a yarn package, according to claim 2, wherein the respective mean values of the data for evaluation are compared respectively with the corresponding reference mean values in the yarn package quality deciding step.

6. A method of discriminating and changing a yarn package, according to claim 2, wherein the respective difference between the maximum and minimum values of the data for evaluation are compared respectively with the corresponding reference values in the yarn package quality deciding step.

7. A method of discriminating and changing a yarn package, according to claim 1, wherein at least either the tension or thickness of the picked weft yarn is detected as a physical matter for evaluating the picked weft yarn in the picking condition detecting step.

8. A method of discriminating and changing a yarn package, according to claim 7, wherein the frequency of faulty picks in a predetermined period is compared with a reference frequency in the yarn package quality deciding step.

9. A method of discriminating and changing a yarn package, according to claim 7, wherein the respective variations of the data for evaluation are compared respectively with the corresponding reference variations in the yarn package quality deciding step.

10. A method of discriminating and changing a yarn package, according to claim 3, wherein the respective mean values of the data for evaluation are compared respectively with the corresponding reference mean values in the yarn package quality deciding step.

11. A method of discriminating and changing a yarn package, according to claim 7, wherein the respective difference between the maximum and minimum values of the data for evaluation are compared respectively with the corresponding reference values in the yarn package quality deciding step.

12. A method of discriminating and changing a yarn package, according to claim 1, wherein the frequency of faulty picks in a predetermined period is compared with a reference frequency in the yarn package quality deciding step.

13. A method of discriminating and changing a yarn package, according to claim 1, wherein the respective variations of the data for evaluation are compared respectively with the corresponding reference variations in the yarn package quality deciding step.

14. A method of discriminating and changing a yarn package, according to claim 1, wherein the respective mean values of the data for evaluation are compared respectively with the corresponding reference mean values in the yarn package quality deciding step.

15. A method of discriminating and changing a yarn package, according to claim 1, wherein the respective difference between the maximum and minimum values of the data for evaluation are compared respectively with the corresponding reference values in the yarn package quality deciding step.

16. A method of discriminating and changing a yarn package, according to claim 1, wherein both the data representing the physical properties of the picked weft yarn for evaluation and the data representing the result of the picking cycles are detected simultaneously in the picking condition detecting step, an the yarn package changing instruction is provided in the yarn package quality deciding step to change the yarn package feeding the weft yarn at present for a new yarn package when both the data correspond respectively to reference conditions defining a defective yarn package.

* * * * *